US005484036A

United States Patent [19]

Cothern

[11] Patent Number: 5,484,036

[45] Date of Patent: Jan. 16, 1996

[54] SAFETY DEVICE FOR LADDERS

[76] Inventor: Terry D. Cothern, P.O. Box 77, Boston, Ky. 40107

[21] Appl. No.: 242,350

[22] Filed: May 13, 1994

[51] Int. Cl.[6] ..... E06C 1/00

[52] U.S. Cl. ..... 182/107; 182/214

[58] Field of Search ..... 182/107, 108, 182/206, 214, 229, 70; 248/168

[56] References Cited

U.S. PATENT DOCUMENTS

| | | | |
|---|---|---|---|
| 1,982,572 | 11/1934 | Colgazier et al. . | |
| 2,352,794 | 7/1944 | Love | 248/168 |
| 3,037,579 | 6/1962 | Barrow | 182/107 |
| 3,792,756 | 2/1974 | Kelly | 182/107 |
| 4,369,860 | 1/1983 | Beane | 182/107 X |
| 4,469,195 | 9/1984 | Sartain | 182/107 X |
| 4,501,201 | 2/1985 | Fitzner et al. | 248/230 X |
| 4,545,460 | 10/1985 | Byrd | 182/107 |
| 4,924,971 | 5/1990 | Rice | 182/107 X |
| 4,989,691 | 2/1991 | Wilkerson et al. | 182/70 |
| 5,067,588 | 11/1991 | Bendickson | 182/107 |

*Primary Examiner*—Karen J. Chotkowski

[57] ABSTRACT

A safety device adapted for removable attachment to a selected one of the rungs of a ladder for securing the ladder to a structure against which it operatively positioned is disclosed. The device features a rigid hollow body which surrounds the selected rung, a pair of flexible straps secured to opposite end portions of the rigid body for being adjustably connected to a portion of the structure, and a flexible sheet or cover connected on one edge portion thereof to one side of the rigid body so that the sheet is disposed between the flexible strap connections. A free edge portion of the sheet opposite the one edge which is connected to the one side of the body is removably connectable to an opposite side of the body so that the sheet can confine the straps between itself and an underside of the body when the straps are not in use to secure the ladder to the structure.

14 Claims, 2 Drawing Sheets

SAFETY DEVICE FOR LADDERS

BACKGROUND OF THE INVENTION

This invention relates generally to a safety device for preventing a ladder from slipping relative to a structure against which it is operatively positioned. More specifically, this invention relates to a safety device which is attachable to a rung of a ladder, which device includes a belt that permits the ladder to be secured to a structure against which it is placed.

Broadly speaking, a number of such belt containing safety devices are known in the prior art. See, for example, U.S. Pat. No. 5,067,588 issued to R. B. Bendickson on Nov. 26, 1991; U.S. Pat. No. 4,924,971 issued to B. M. Rice on May 15, 1990; U.S. Pat. No. 4,545,460 issued to J. L. Byrd on Oct. 8, 1985; U.S. Pat. No. 3,792,756 issued to H. Kelly on Feb. 19, 1974; U.S. Pat. No. 3,037,579 issued to W. H. Barrow on Jun. 5, 1962; and U.S. Pat. No. 1,982,572 issued to E. G. Colglazier, et al. on Nov. 27, 1934. The patent to Bendickson discloses a belt which is directly attachable between a ladder and a structure against which the ladder rests, which belt contains two buckles, each of which can be placed at a desired position on the belt. The reference belt is not permanently attachable to a ladder. The patent to Rice discloses a flexible metal cable containing hook members on opposite ends thereof adapted for attachment to an eaves through of a building against which a ladder is placed. The Rice cable assembly is only usable with ladders having hollow rungs containing openings along the outside surfaces of the ladder legs, which openings align and communicate with the passageways through the hollow rungs, since a central portion of the cable must extend through a selected one of the rungs. The Byrd patent discloses a strap containing a central portion and two end portions connected to opposite ends of the central portion. Each end strap has a pair of rigid buckles connected to one end thereof for attachment to a free end of the central strap and a latch for looping each end strap about a different one of the ladder legs. The Byrd strap is adapted solely for stabilizing a ladder in an upright position against a pole or tree trunk. The Kelly patent discloses a pair of belts connected to different ones of a pair of end brackets mounted on upper ends of the legs of a ladder for use in stabilizing the ladder against a pole or tree trunk. The pole or tree trunk fits between the belts. The patent to Colglazier et al. discloses a double hook assembly which is attached to a rung of a ladder by means of a chain wrapped around the selected rung and connected back on itself by means of a hook attached to the free end of the chain. The double hook assembly holds the ladder in place in front of a window by extending through the base of the window opening and catching against an interior wall. The Colglazier et al. device is only usable where unfinished walls are involved as the double hooks which bite an interior wall to stabilize a ladder would most certainly do damage to a finished wall.

Lastly, the patent to Barrow is the only one of the previously cited patents which includes a belt attached to a rigid body, which body is attachable about the rung of a ladder. The body includes a plate having an arcuate cut out portion for fitting against a post, whereby the Barrow device is only adapted for use in securing a ladder to a curved surface such as a pole or tree trunk. Moreover, as is also true in all of the aforementioned patents, the belt can not be conveniently stored against the body of the device when not in use.

By means of my invention, these and other shortcomings of prior art ladder safety devices are substantially overcome.

SUMMARY OF THE INVENTION

It is an object of my invention to provide a safety device for holding a ladder in a stable position relative to a structure against which the ladder is operatively placed.

It is also an object of my invention to provide a safety device for holding a ladder against a structure by means of a pair of straps which straps can be conveniently stored under a ladder rung when not in use.

Briefly, in accordance with my invention, there is provided a safety device for holding a ladder in a stable position relative to a structure against which the ladder is operatively placed. The safety device includes a rigid body adapted to surround a ladder rung and a pair of flexible straps attached on corresponding ends thereof to opposite end portions of the body. A flexible sheet is also included which is attached to the body for selectively confining the straps in a stored condition against the body when the straps are not being used to connect a ladder to a structure against which the ladder is placed.

These and other objects, features and advantages of the present invention will become apparent to those skilled in the art from the following detailed description and attached drawings upon which, by way of example, only a preferred and one other selected embodiment of the invention is explained and illustrated.

DESCRIPTION OF THE PREFERRED EMBODIMENT

Figure 4:
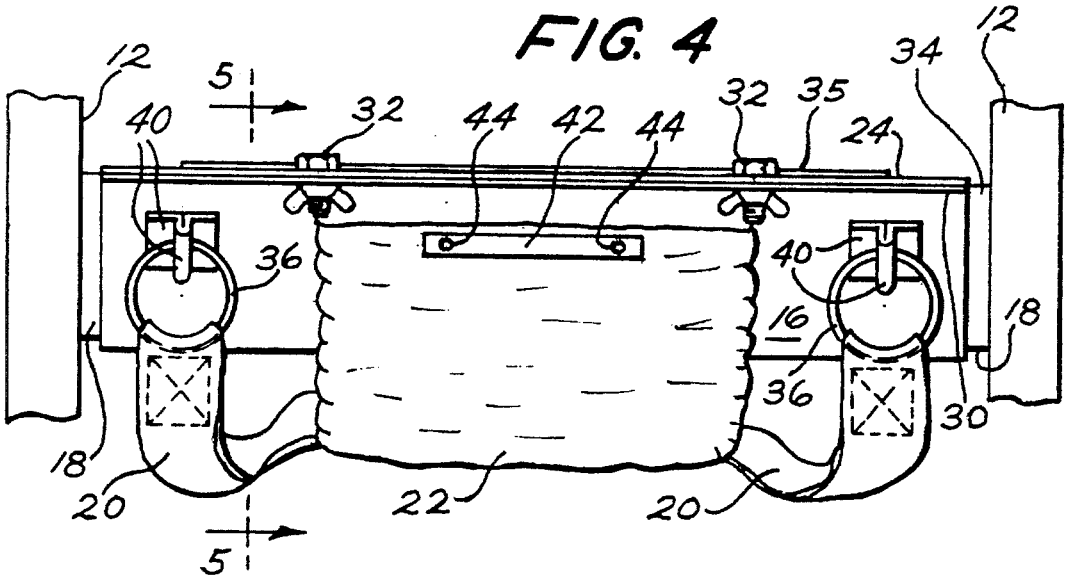
FIG. 4 shows a rear elevation view of the safety device of FIGS. 1–3 as applied to a D-shaped rung of a conventional ladder with the straps folded in a stored position between the rung and the covering sheet.
Figure 5:
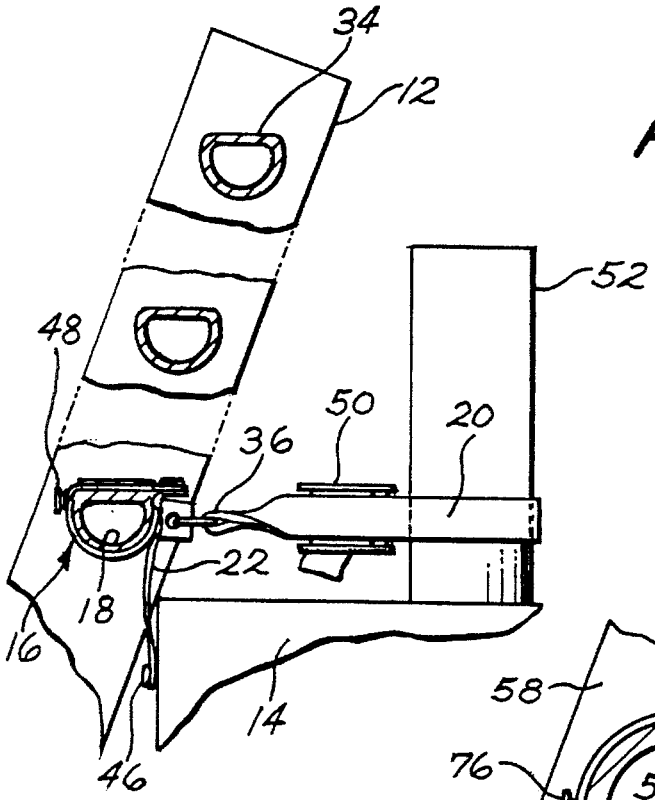
FIG. 5 shows a cross-sectional elevation view of the safety device of FIGS. 1–4 as viewed along cross-section lines 5—5 of FIG. 4 except that the strap covering sheet is open and the straps are in use to secure the ladder to a structure.

Referring now to the drawing figures and, in particular, FIGS. 1–4, there is shown, in a preferred embodiment of my invention, a safety device, generally designated 10, for holding a conventional ladder 12 in a stable, upright position against a structure 14 to be climbed. The device 10 includes a rigid body 16 adapted to surround a selected one of the D-shaped rungs 18 of the ladder 12 in relatively close fitting relationship (FIGS. 4–5). The device 10 also includes a pair of flexible straps 20, and a flexible strap cover or sheet 22. The rigid body 16 can be constructed of any suitably rigid, durable material of relatively high strength, including a metal such as aluminum alloy or steel. The straps 20 can be constructed of a suitably strong woven fabric and the sheet 22 is preferably constructed of a water impervious woven fabric or non-woven fabric such as a suitable polymer plastic.

The rigid body 16 of the present example can be fashioned from a relatively flat rectangularly shaped metal plate. The plate is bent so as to include one edge portion 24 which is flat and an opposing edge portion 26 which is arcuately curved back toward a free edge 28 of the edge portion 24 (See FIGS. 1–3). The edge portion 26 terminates at a flange 30, which flange projects outwardly therefrom so as to lie flush against a free end portion of the edge portion 24, especially when the edge portion 24 and flange 30 are tightly held together by a pair of nuts and bolts 32. Upon removing the nuts and bolts 32 from the rigid body 16, the flange 30 and, the free end portion of the edge portion 24 against which the flange 30 mates, can be pried apart to permit the rigid body 16 to be mounted on or removed from one of the rungs 18 as desired by sliding the rung through the resulting opening. The springable nature of the metal comprising the body 16 permits the flange 30 to return against the end portion of the surface 24 against which it normally mates after having been sprung apart to apply the body 16 to or remove it from the rung 18. But even if the flange 30 remains sprung apart from the mating end portion of the surface 24 after such an operation, application of the nuts and bolts 32 to the assembly will cause the mating elements to lie flush against one another once again. Thus, the rigid body 16 is adapted for use with a ladder 12 having D-shaped rungs 18 wherein the flat edge portion or surface 24 lies upon a flat upper surface 34 of a selected one of the D-shaped rungs 18 as shown in FIGS. 4–5. Correspondingly, the arcuately curved portion 26 of the body 16 generally conforms to the curved surface of the rung 18. A conventional foot traction pad 35 is glued to the flat surface 24 to enhance a climbers footing on the surface 24.

Figure 1:
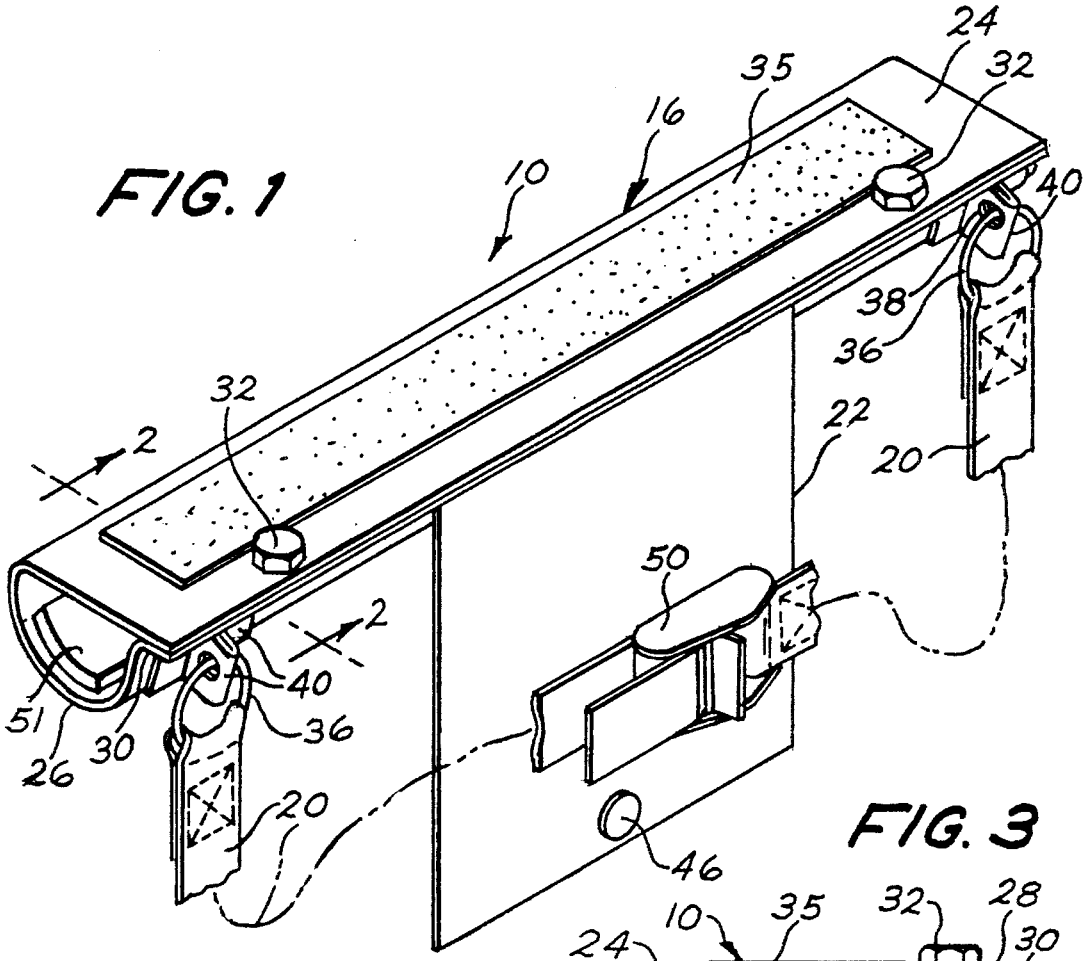
FIG. 1 shows a perspective view of a safety device for securing a ladder having rungs of D-shaped cross-section to a structure to be climbed, fragments of a ladder securing strap and a strap covering sheet being shown in an inoperative condition, thus illustrating a preferred embodiment of my invention.
Figure 3:
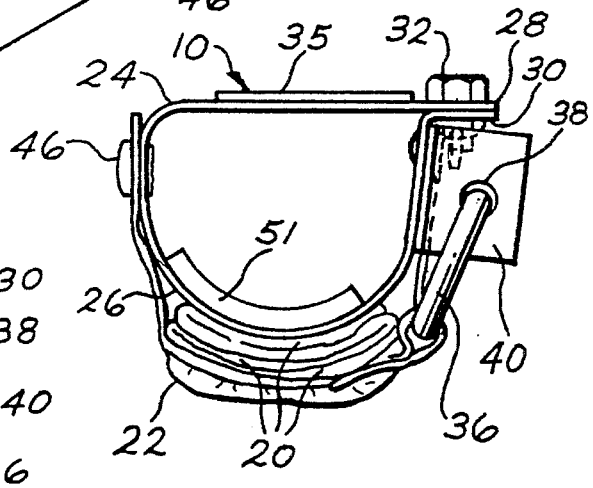
FIG. 3 shows an end elevation view of the safety device of FIGS. 1–2 wherein the ladder securing strap is bundled and stored between the device body and the covering sheet.
Figure 2:
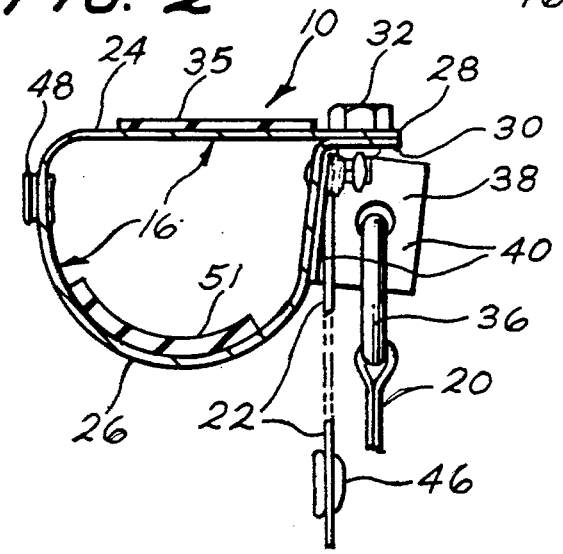
FIG. 2 shows a cross-sectional view of the safety device of FIG. 1 as viewed along cross-section lines 2—2 of the latter mentioned figure.

The belts 20 are attached on corresponding ends thereof to a pair of rings 36 and the rings 36 are, in turn, connected through apertures 38 in a pair of T-shaped metal tabs 40 which are fixedly connected to one side of the body 16 under the flange 30 as, for example, by weld joints. The sheet 22 is preferably rectangularly by shaped and is connected along one edge portion thereof to the body 16 by an elongated bar 42 which is, itself, attached to the body 16 by means of rivets 44. When not in use, the sheet 22 hangs downwardly below the bar 42 as shown in FIGS. 1–2. An edge portion of the sheet 22, opposite that containing the bar 42, contains a conventional snap 46 which is adapted to mate with and connect to a conventional snap connector 48, the latter being located on a central front edge of the edge portion 26 near where it joins with the flat surface 24.

A free end portion of one of the straps 20 contains a suitable and conventional buckle 50 which permits it to be joined to the other one of the straps 20, preferably, in an adjustable manner. FIG. 5 shows the two straps 20 buckled together and looped around a pipe 52 projecting from atop the structure 14 against which the ladder 12 is placed for climbing for holding the ladder 12 in a stable position. I recommend placing the body 16 upon the third rung 18 down from the top of the ladder 12 in most instances, although this may not always be desirable and, in any event, the user may select any one of the rungs desired. An elongated strip 51 of compressible resilient material is glued to a lower portion of the interior curved surface of the body 16 to aid in rigidly securing the body 16 to the rung 18 so that the body 16 does not slide either laterally or rotationally on the rung 18 when the nuts and bolts 32 are tightly fastened in place.

Figure 6:
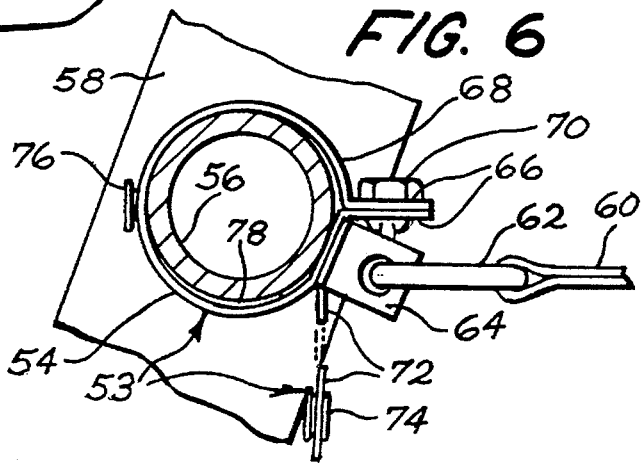
FIG. 6 shows an end elevation view of a safety device for securing a ladder having cylindrically shaped rungs to a structure to be climbed, thus illustrating another embodiment of my invention.

Referring now to FIG. 6 there is shown, in another embodiment of my invention, a safety device generally designated 53 which includes a rigid body 54 which is adapted to surround a selected one of the cylindrically shaped rungs 56 of a conventional ladder 58 in relatively close fitting relation. Thus, in this example, the rigid body is generally cylindrically shaped and that is essentially the only difference between the device 52 of the present example and the device 10 of the prior example. As in the prior example, the reference device 53 also includes a pair of straps 60 (only one of which need be shown) attached to a pair of rings 62 which are, in turn, attached to T-shaped tabs 64 welded or otherwise suitably connected to a rearward side of the body 54 below a pair of flanges 66. The flanges 66 project generally radially outwardly from opposing edges of a cylindrically shaped surface 68 of the body 54 which encloses the rung 56. A pair of nuts and bolts 70 releasably fasten the flanges 66 together. A sheet 72 is fastened along an upper edge portion thereof to a rearwardly facing surface portion of the body 54 as viewed, in the same manner as in the previous example. A free end portion of the sheet 72 contains a snap 74 which permits it to be removably attached to a mating snap connector 76 located on a frontally facing surface of the body 54. As in the previous example, an elongated strip of compressible, resilient padding 78 can be glued along a lower portion of the interior surface of the body 54 to be compressed against the rung 56 to inhibit lateral and/or rotational slippage of the body 54 along or around the rung 56 when the nuts and bolts 70 are tightly fastened to the flanges 66.

Although the present invention has been shown and described in detail with respect to certain embodiments thereof, it is not intended that such details limit the scope of this patent otherwise than as specifically set forth in the following claims.

I claim:

1. A safety device for holding a ladder in a stable position relative to a structure against which said ladder is operatively placed comprising a rigid body adapted to surround a rung of a ladder, means for securing the legs of said ladder against a linear surface when said ladder is disposed in an operative position against said surface, said securing means comprising a pair of flexible straps attached on corresponding ends thereof to opposite end portions of said body, and flexible sheet means attached to said body for selectively confining said straps in a stored condition against said body when said straps are not being used to connect a ladder to a structure against which said ladder is placed.

2. The safety device of claim 1 wherein said rigid body is constructed of metal.

3. The safety device of claim 1 wherein said rigid body comprises a plate, one edge portion of which is fiat, an opposing edge portion of which is arcuately curved back toward a free edge of said one edge portion, a flange projecting outwardly from said arcuately curved edge portion which is adapted to lie flush against a free end portion of said one edge portion, said flange and free end portion being openable relative to one another for sliding said body onto said ladder rung such that said rung is disposed within said body between said one edge portion and said arcuately curved edge portion, and means for fastening said free end portion to said flange with said rung extending through said body.

4. The safety device of claim 3 wherein said fastening means comprises a pair of laterally spaced apart nuts and bolts.

5. The safety device of claim 3 wherein said sheet is rectangularly shaped and is fastened along one edge portion thereof to one side of said body between said opposite end portions wherein said straps are attached, said sheet being adapted to hang downwardly from said body in an inoperative state when said straps are in use to hold said ladder against a structure, said sheet containing a fastener on a free end portion thereof which is opposite said one end portion.

6. The safety device of claim 1 wherein said rigid body comprises a plate having a substantially circular arc shaped portion adapted to substantially surround a cylindrically shaped ladder rung, a pair of flanges projecting substantially radially outward from opposing ends of said arc shaped portion and being adapted to fit flush against one another when fastened together with said rung being surrounded by said arc shaped portion, and means for fastening said flanges flush against one another.

7. The safety device of claim 6 wherein said fastening means comprises a pair of laterally spaced apart nuts and bolts.

8. The safety device of claim 1 wherein said sheet is substantially rectangularly shaped, one edge portion of said sheet being secured to one side of said body, an opposing edge portion of said sheet being removably fastenable to a side of said body which is opposite said one side such that said straps can be folded and stored between said sheet and an underside of said body when said straps are not in use.

9. The safety device of claim 1 further comprising a pair of T-shaped tabs attached to opposite end portions of one side of said body, a pair of rings, each of which is connected to a different one of said tabs, each of said straps, being connected to a different one of said rings, said sheet being connected on one edge portion thereof to said body between said tabs and being of a length sufficient to wrap around said body, with said straps being folded between said sheet and said body, and being releasably connectable on an opposite end portion thereof to said body on a side of said body opposite said tabs.

10. The safety device of claim 1 wherein said sheet is constructed of water resistant material.

11. The safety device of claim 1 wherein said sheet is constructed of plastic.

12. The safety device of claim 1 wherein said body is adapted to surround a D-shaped ladder rung in relatively close fitting and conforming relationship.

13. The safety device of claim 1 wherein said body is adapted to surround a cylindrically shaped ladder rung in relatively close fitting and conforming relationship.

14. The safety device of claim 1 further comprising a strip of compressible, resilient material extending substantially across a hollow interior surface of said body for compressing against said rung to inhibit lateral and rotational slippage of said body relative to said rung.

* * * * *

UNITED STATES PATENT AND TRADEMARK OFFICE

CERTIFICATE OF CORRECTION

PATENT NO. : 5,484,036

DATED : January 16, 1996

INVENTOR(S) : Terry D. Cothern

It is certified that error appears in the above-indentified patent and that said Letters Patent is hereby corrected as shown below:

Col. 1, line 29, Background of the Invention,
"through" should read --trought--

Signed and Sealed this

Twenty-sixth Day of March, 1996

Bruce Lehman

*Attest:*

BRUCE LEHMAN

*Attesting Officer*

*Commissioner of Patents and Trademarks*